US006616475B2

(12) United States Patent
Nagai

(10) Patent No.: US 6,616,475 B2
(45) Date of Patent: Sep. 9, 2003

(54) ELECTRIC WIRE CONNECTING STRUCTURE OF LAMP UNIT

(75) Inventor: Kentaro Nagai, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/925,306

(22) Filed: Aug. 10, 2001

(65) Prior Publication Data

US 2002/0028597 A1 Mar. 7, 2002

(30) Foreign Application Priority Data

Aug. 10, 2000 (JP) ..... P 2000-242888

(51) Int. Cl.[7] ..... H01R 4/24
(52) U.S. Cl. ..... 439/395; 439/404; 439/217
(58) Field of Search ..... 439/395, 404, 439/405, 419, 422, 217, 423–427

(56) References Cited

U.S. PATENT DOCUMENTS 4,508,399 A * 4/1985 Dowling et al. ..... 439/419
5,069,625 A * 12/1991 Brandt ..... 439/404
5,611,709 A * 3/1997 McAnulty ..... 439/422
5,672,000 A * 9/1997 Lin ..... 439/419
5,805,402 A 9/1998 Maue et al.
5,860,831 A * 1/1999 Roder et al. ..... 439/422
5,944,463 A * 8/1999 Savage ..... 439/419

FOREIGN PATENT DOCUMENTS

| | | |
|---|---|---|
| EP | 0 333 039 | 9/1989 |
| JP | 4-57454 | 5/1992 |
| JP | 5-131882 | 5/1993 |

* cited by examiner

*Primary Examiner*—Hien Vu
(74) *Attorney, Agent, or Firm*—Sughrue Mion, PLLC

(57) ABSTRACT

A lamp unit attached to a lamp-attaching window provided in a roof trim for covering a vehicle body panel comprises a lamp functional portion composed of a reflector (31), a switch unit (33) and a bulb, and a design portion that is a cover lens. For each of bus bars (50, 60, 70) of the switch unit (33), there are provided each of round conductor connecting portions (52, 62, 72) according to a FFC (40) having round conductors fixed to the respective bus bars (50, 60, 70), and each of flat conductor connecting portions (55, 65, 75) according to a FFC having flat conductors.

1 Claim, 7 Drawing Sheets

ELECTRIC WIRE CONNECTING STRUCTURE OF LAMP UNIT

BACKGROUND OF THE INVENTION

1. Technical Field of the Invention

The present invention relates to electric wire connecting structure of a lamp unit, and particularly to electric wire connecting structure between an electric wire and a lamp unit when the lamp unit such as a room lamp or the like is attached to a lamp attaching window of an interior wall material such as a roof trim or the like that covers a vehicle body panel.

2. Related Art

In case that a lamp unit such as a room lamp or a courtesy lamp is attached to an interior wall material such as a roof trim that covers a vehicle body panel or a door trim, each lamp unit has been attached to a lamp-attaching window opened in the interior wall material.

FIG. 6 is a sectional view for explaining a related example of the lamp unit attaching structure, which has been disclosed in JP-A-4-57454U and JP-A-5-131882. As shown in FIG. 6, a room lamp 13 is attached to a lamp attaching window 15 opened in a roof trim 3 used as an interior wall material for covering a body ceiling 2 that is a body panel of a vehicle body 1.

The room lamp 13 is mainly composed of a housing 6, a bulb (electric bulb) 9 and a cover lens 5. The bulb 9 is inserted between bus bars 8 functioning as a bulb contact fixed to the housing 6, and one of the bus bars 8 is connected through a coated electric wire 21 to a room lamp side-connector 11. Tapping screws 7 for fixing the room lamp 13 to a roof trim 3 are attached to the housing 6. Attaching holes 4, to which the tapping screws 7 are inserted, are provided at the roof trim 3.

In case that the above room lamp 13 is attached to the roof trim 3, a body side connector 12 of a roof harness 10 is pulled down once from a lamp-attaching window 15 of said roof trim 3, and fitted and connected to the room lamp side connector 11 of the room lamp 13. Thereafter, the connectors 11, 12 are respectively located on the roof trim 3 together with the roof harness 10 through the lamp-attaching window 15, and then the room lamp 13 is fixed to the lamp-attaching window 15 by the tapping screws 7.

In case that one of the bus bars 8 is connected as an electric wire connecting terminal to a coated electric wire 21 of the room lamp-side connector 11 as described above, as shown in FIG. 7, the coated electric wire 21 is press-fitted and connected to a press-fitting terminal portion 22 provided at the bus bar 8 functioning as the electric wire connecting terminal.

The press-fitting terminal portion 22 includes a pair of press-fitting pieces 23, 23 that are provided erectly for a bottom plate 8*a* in parallel, and a U-shaped press-fitting groove 24 that is cut from an upper end edge to the downside is formed in each of these press-fitting pieces 23.

When the coated electric wire 21 including a round conductor 21*b* having a round section is forced into the press-fitting groove 24, the press-fitting groove 24 is cut into an insulating coat 21*a* and the round conductor 21*b* is press-fitted and connected to the press-fitting groove 24, so that the coated electric wire 21 of the room lamp side-connector 11 and the bus bar 8 of the room lamp 13 are electrically connected to each other.

However, the electric wire for connecting the roof harness 10 on the vehicle body side to the room lamp 13 is not limited to the coated electric wire 21 shown in FIG. 7. Recently, a flat circuit body such as FFCs (flexible flat cable) 40 and 100 as shown in FIG. 8 is used as such the electric wire.

And, in case of an electric wire formed by covering the plural round conductors 40*b* with an insulating coat 40*a* such as the FFC 40 shown in FIG. 8A, the round conductor 40*b* is press-fitted and connected to the press-fitting groove 24 of the press-fitting terminal portion 22 as shown in FIG. 7, whereby the bus bar 8 of the room lamp 13 and the roof harness on the vehicle body side can be electrically connected to each other. However, in case of an electric wire formed by covering flat conductors 100*b* having rectangular sections with an insulating coat 100*a* such as the FFC 100 shown in FIG. 8B, it cannot be press-fitted and connected to the press-fitting terminal portion 22 as shown in FIG. 7.

In order to connect the above FFC 100 having the flat conductors 100*b* to the room lamp 13, it is necessary to use an electric wire-connecting terminal having each connecting terminal portion for welding or for piercing. Therefore, the room lamp 13 requires rearrangement of the electric wire connecting terminals that are different in the connecting terminal portion according to the shape of the wire conductor on the body side, and it must hold the plural kinds of electric wire connecting terminals, so that there is a problem that wide application is low.

SUMMARY OF THE INVENTION

Accordingly, an object of the invention is to solve the above problem and to provide electric wire connecting structure of a lamp unit in which connection to an electric wire on a vehicle body side can be easily performed regardless of mode of a wire conductor and wide application is high.

The above object of the invention is achieved by electric wire connecting structure comprising:

a lamp unit attachable to a lamp-attaching window provided in an interior wall material covering a vehicle body panel, the lamp unit including a design portion and a lamp functional portion, and an electric wire connecting terminal provided on the lamp functional portion, wherein the electric wire connecting terminal includes a round conductor connecting portion and a flat conductor connecting portion which correspond to a conductor shape of an electric wire lain on a body panel side of the interior wall material and fixed to the electric wire connecting terminal.

According to the above constitution, in case that a conductor of an electric wire that is laid on the body panel side and fixed to the electric wire connecting terminal is a round conductor, the electric wire can be fixed to the round conductor connecting portion. On the other hand, in case that a conductor of an electric wire is a flat conductor, the electric wire can be fixed to the flat conductor-connecting portion.

Namely, regardless of mode of the fixed wire conductor, the electric wire on the vehicle body side can be reliably fixed to the electric wire connecting terminal, and it is not necessary to prepare the plural kinds of electric wire connecting terminals according to the shape of the wire conductor.

Accordingly, productivity of the lamp unit improves and wide application thereof heightens, so that a manufacturing cost can be reduced.

Preferably, the electric wire connecting terminals are put side by side on a lamp-attaching portion of the lamp functional portion, and the round conductor connecting portion including a press-fitting terminal portion is arranged on a more distant side from the lamp-attaching portion than the flat conductor connecting portion.

In this case, the round conductor-connecting portion becomes a press-fitting terminal portion that is easy in connection working. Therefore, connecting work performance of the electric wire in relation to the lamp functional portion improves.

Further, since the press-fitting terminal portion is arranged on the distant side from the lamp-attaching portion that becomes a heat generator, its terminal portion is difficult to receive influence of heat and easy to obtain connection reliability.

DETAILED OF PREFERRED EMBODIMENT

Electric wire connecting structure of a lamp unit according to one embodiment of the invention will be described below in detail with reference to the drawings.

Figure 1:
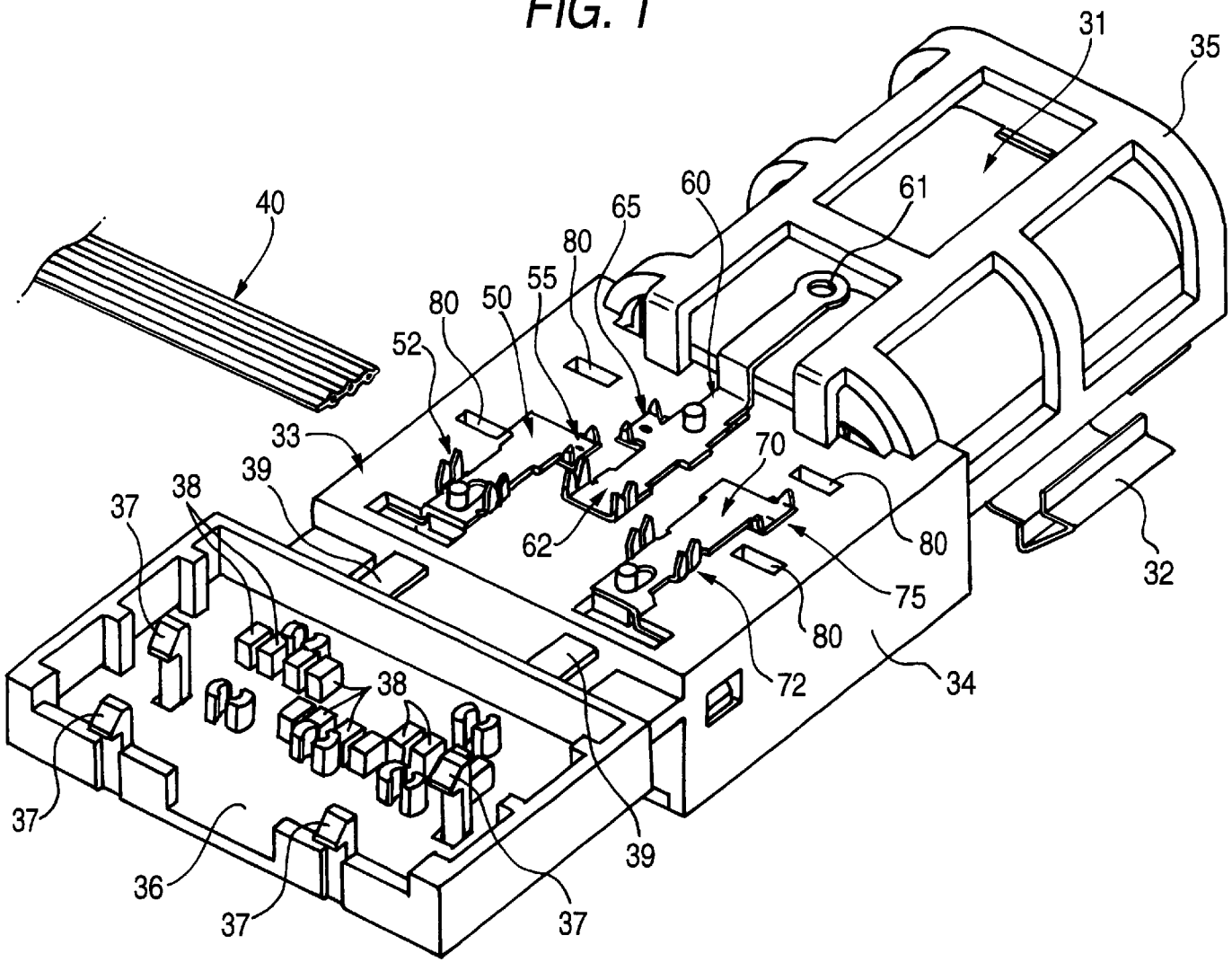
FIG. 1 is an exploded perspective view of a lamp functional portion in a room lamp having electric wire connecting structure of lamp unit according to one embodiment of the invention.
Figure 2:
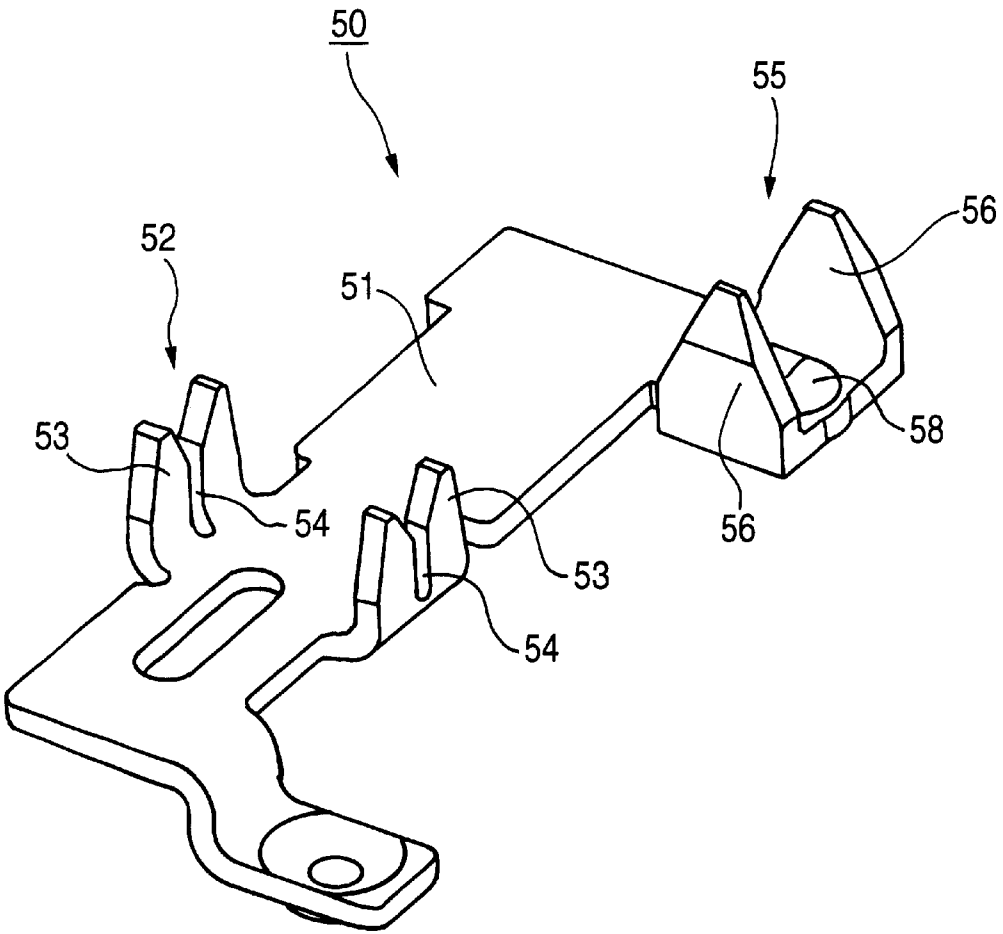
FIG. 2 is a whole perspective view of an electric wire-connecting terminal shown in FIG. 1.
Figure 3:
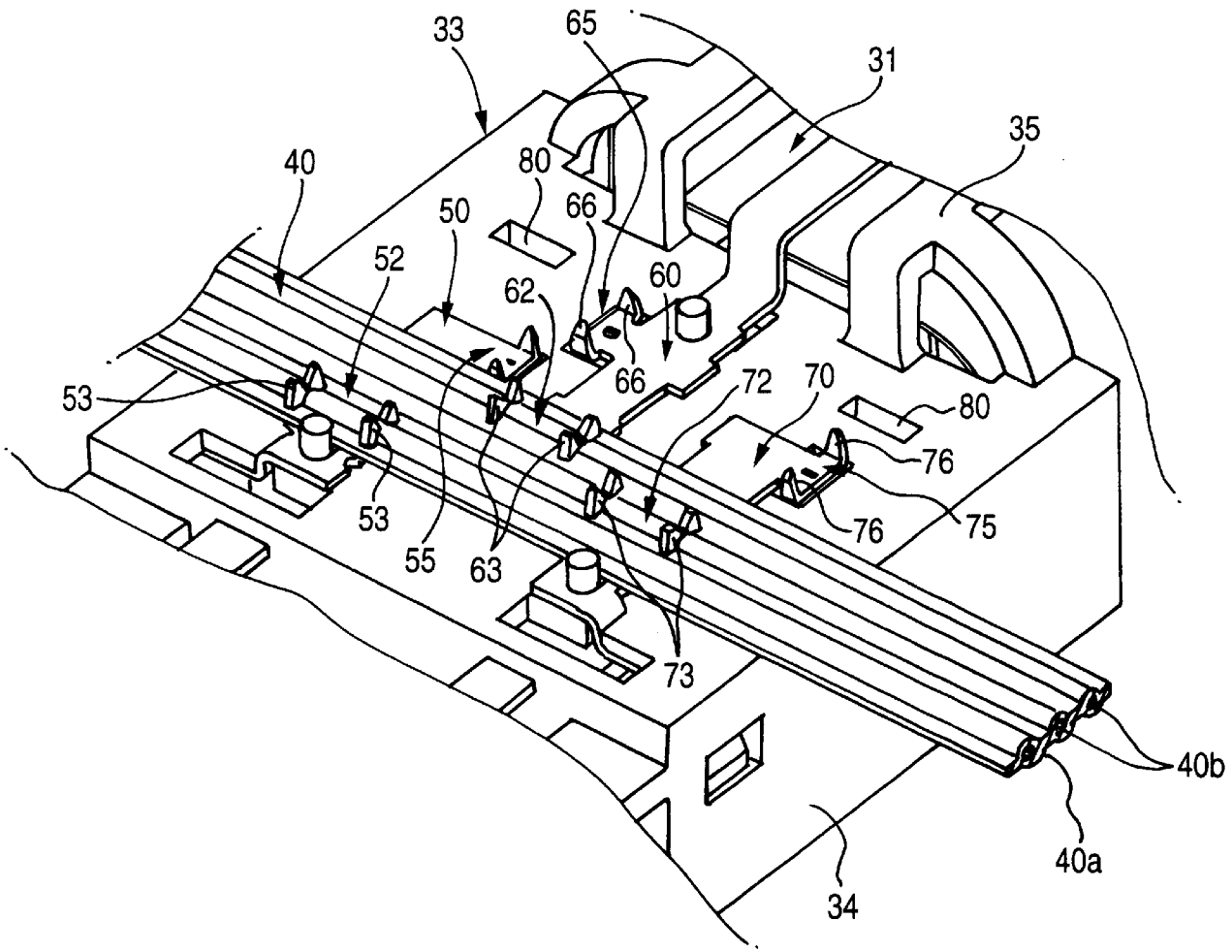
FIG. 3 is an enlarged perspective view showing a state where an electric wire having round conductors is fixed to the lamp functional portion shown in FIG. 1.
Figure 4:
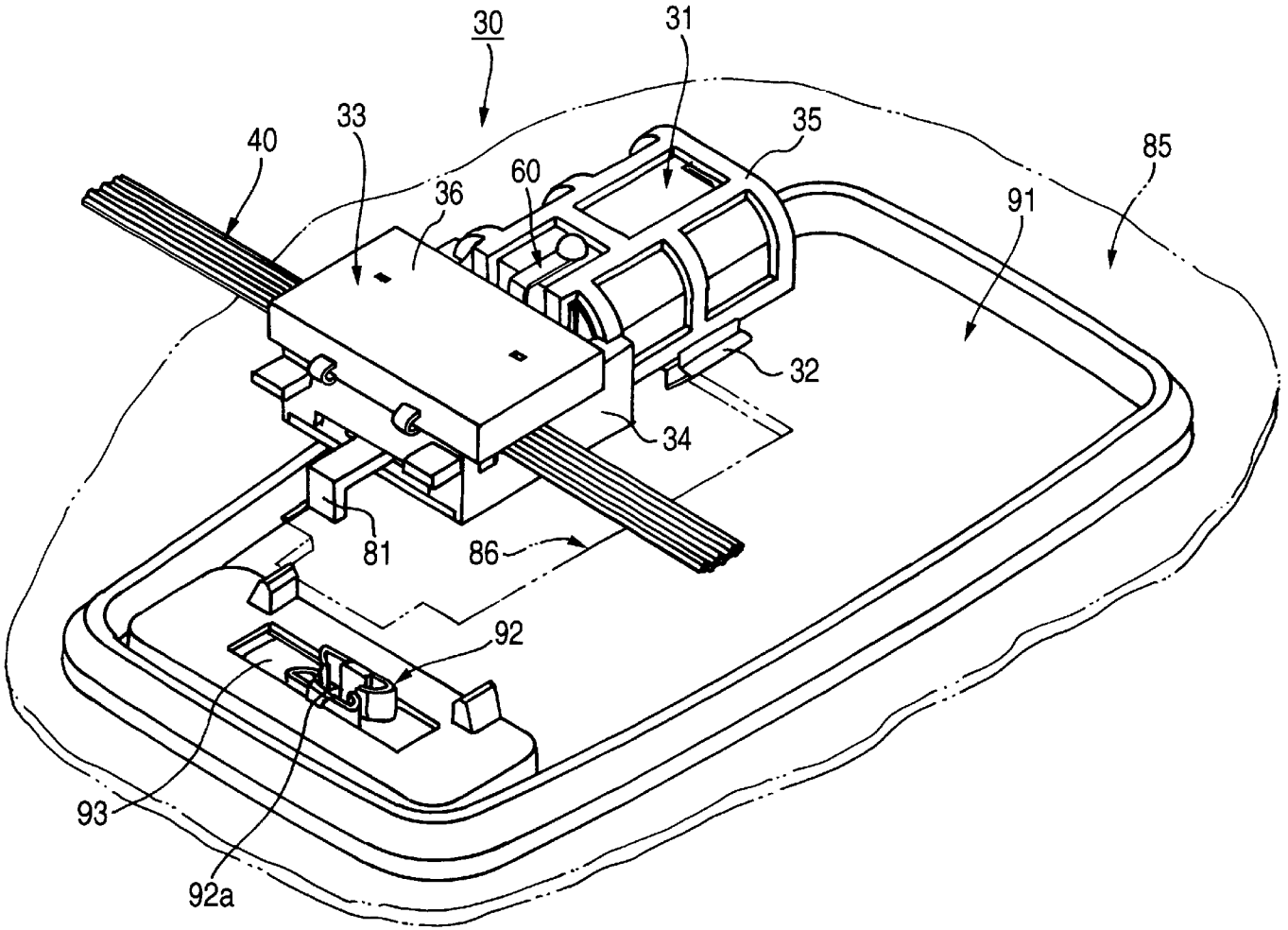
FIG. 4 is a perspective view for explaining an attaching process of the room lamp shown in FIG. 3 to a roof trim.
Figure 5:
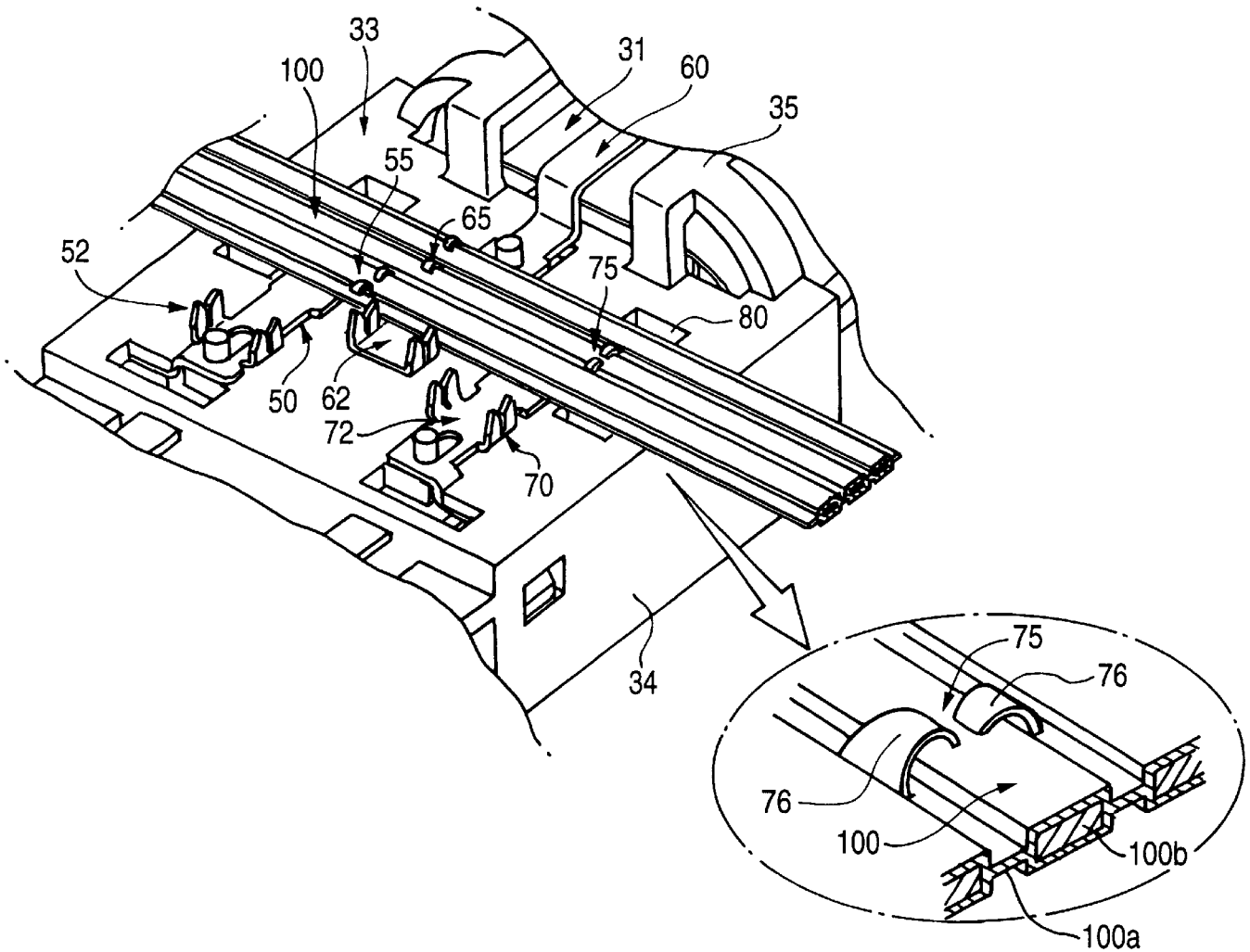
FIG. 5 is an enlarged perspective view showing a state where an electric wire having flat conductors is fixed to the lamp functional portion shown in FIG. 1.
Figure 6:
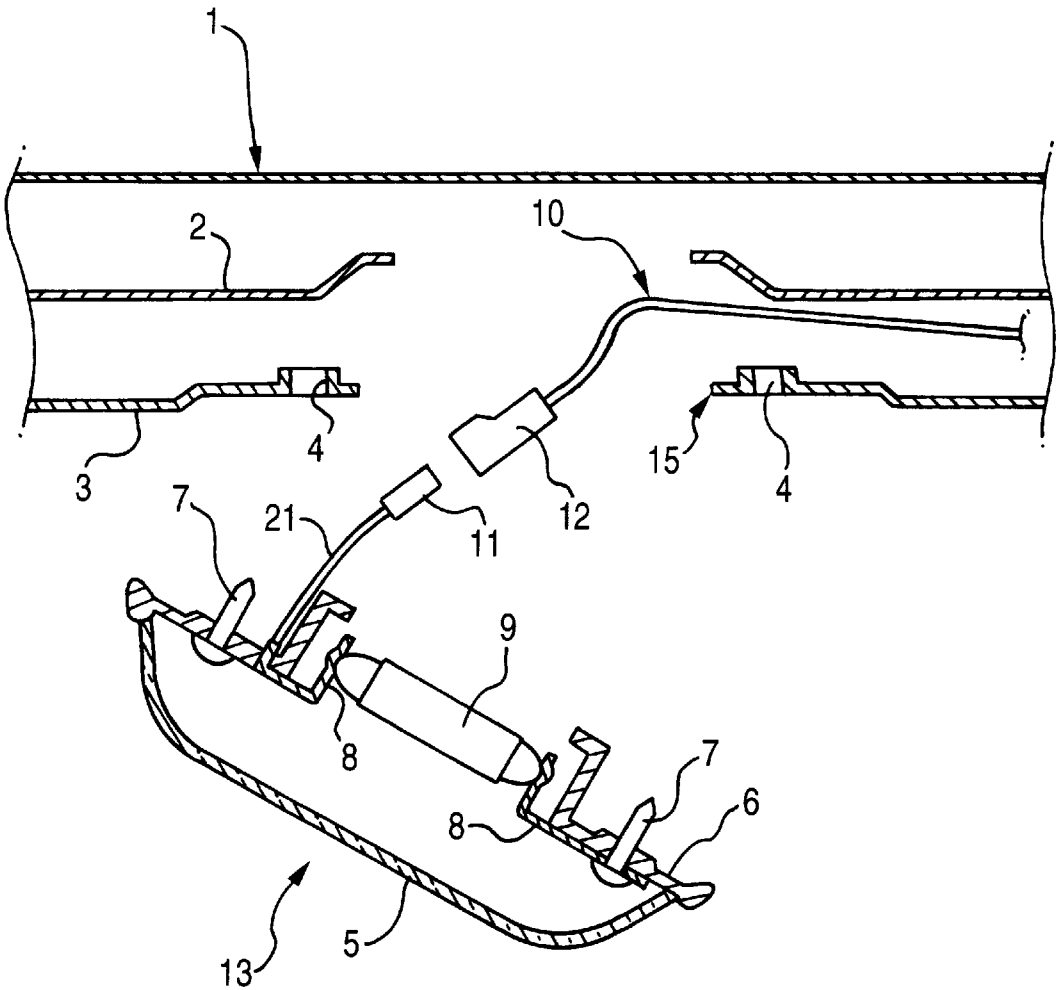
FIG. 6 is a sectional view for explaining a related lamp unit attaching structure.
Figure 7:
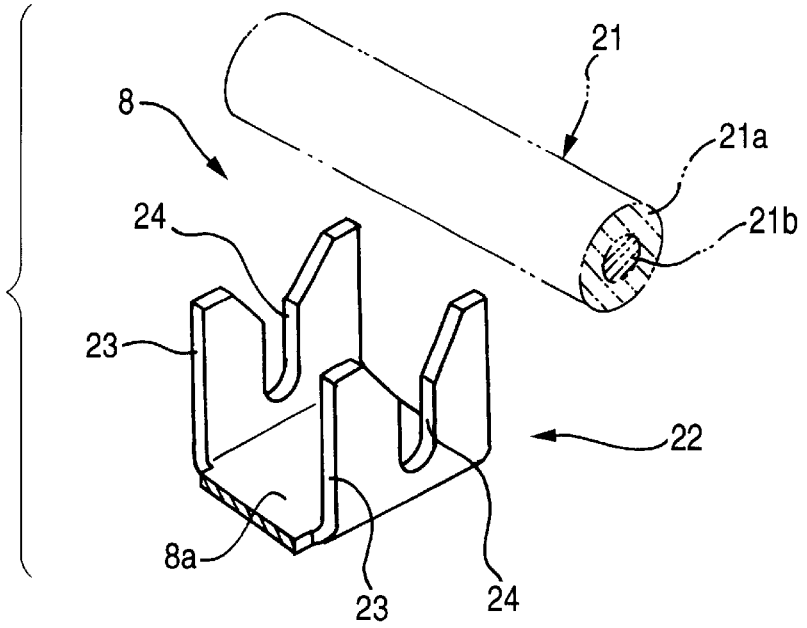
FIG. 7 is a main portion enlarged perspective view showing the related lamp unit attaching structure.

FIG. 1 is an exploded perspective view of a lamp functional portion in a room lamp having electric wire connecting structure of a lamp unit according to one embodiment of the invention. FIG. 2 is a whole perspective view of an electric wire connecting terminal shown in FIG. 1. FIG. 3 is an enlarged perspective view showing a state where an electric wire having round conductors is fixed to the lamp functional portion shown in FIG. 1. FIG. 4 is a perspective view for explaining an attaching process of the room lamp shown in FIG. 3 to a roof trim. FIG. 5 is an enlarged perspective view showing a state where an electric wire having flat conductors is fixed to the lamp functional portion shown in FIG. 1.

A room lamp 30 of this embodiment shown in FIGS. 1 to 5 is a lamp unit that is attached to a lamp-attaching window 86 opened in a roof trim 85 used as an interior wall material for covering a vehicle body panel (not shown) (refer to FIG. 4).

The room lamp 30, as shown in FIG. 4, is composed of a reflector 31 having one of bulb contacts, a switch unit 33 having the other bulb contact, and a bulb (not shown) inserted between these both bulb contacts; and comprises a lamp functional portion attached on the vehicle body panel side of the roof trim 85 and a design portion attached on the room side of the roof trim 85. As shown, the design portion is disposed below the roof trim 85 (or interior wall), and the lamp functional portion is disposed above the design portion.

The reflector 31 is a reflection unit formed integrally by press-molding a metal plate such as stainless that is a conductive material. The reflector 31 is bent so that its section if formed nearly in the shape of letter C. One bulb contact (not shown) bent nearly at the right angle at an end edge of the upper wall is provided at one of open ends in the longitudinal direction of the reflector 31 (on the right side in FIG. 1) to constitute a lamp-attaching portion.

Further, a pair of trim attaching portions 32, which can fit into the lamp-attaching window 86 of the roof trim 85,are bent and formed at lower end edges of the both sidewalls of the reflector 31.

As shown in FIG. 1, in the switch unit 33, a switch circuit (not shown) connected to the other bulb contact (not shown) is accommodated in an insulating housing 34, and bus bars 50, 60 and 70 that are electric wire connecting terminals of the switch circuit are arranged on the upper surface of the insulating housing 34 so as to be exposed outside.

Further, a switch lever 81 is provided at the switch unit 33, which is used to intermittently operate the switch circuit capable of switching ON/OFF of the bulb (refer to FIG. 4).

Further, the insulating housing 34 includes a strain relief cover 36 for fixing an electric wire is formed integrally a reflector protect cover 35 through a pair of flexible hinges 39, 39.

And, these switch unit 33 and reflector 31 are integrally assembled, and a part of the upper surface of the reflector 31 is covered with the reflector protect cover 35. Namely, the bus bars 50, 60 and 70 used as the electric wire-connecting terminal are put side by side with the reflector 31 that is the lamp-attaching portion of the lamp functional portion.

Figure 8A:
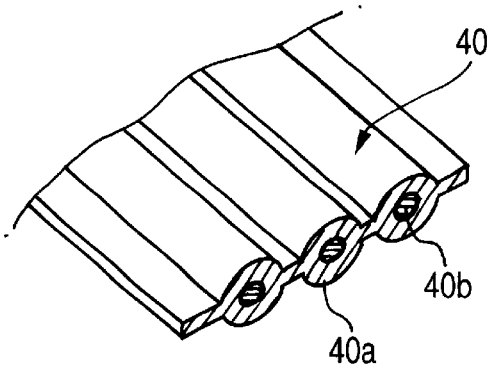
FIG. 8A is an enlarged perspective view of a FFC having round conductors.
Figure 8B:
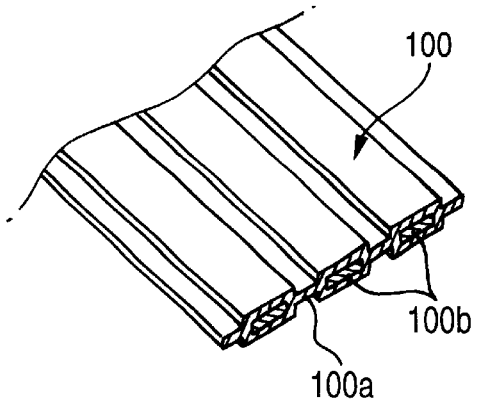
FIG. 8B is an enlarged perspective view of a FFC having flat conductors.

Round conductor connecting portions 52, 62 and 72 and flat conductor connecting portions 55, 65 and 75 are respectively provided at the bus bars 50, 60 and 70, and correspond to the shape of each conductor of a FFC 40 or a FFC 100 (refer to FIG. 8) used as an electric wire that is laid on the vehicle body panel side of the roof trim 85 and to be fixed to these bus bars 50, 60 and 70.

As shown in FIG. 2, the bus bar 50 includes the round conductor connecting portion 52 that is a press-fitting terminal portion comprising a pair of parallel press-fitting pieces 53, 53 that are formed connectedly at the both side edges of a bottom plate 51 and stand erect, and the flat conductor connecting portion 55 comprising a pair of parallel piercing portions 56, 56 that are formed connectedly at the both side edges of the bottom plate 51 and stand erect and a convex portion (indent) 58 formed projectingly in the center of the bottom plate 51.

A U-shaped press-fitting groove 54 cut from the upper end edge toward the downside is formed in the press-fitting piece 53 of the round conductor-connecting portion 52. When the FFC 40 provided with the round conductor 40*b* having a round section is forced into the press-fitting groove 54, the press-fitting groove 54 is cut into an insulating coat 40*a* and the corresponding round conductor 40*b* is press-fitted and connected to the press-fitting groove 54, so that the FFC 40 and the bus bar 50 of the switch unit 33 are electrically connected to each other easily (refer to FIG. 3).

On the other hand, regarding the flat conductor connecting portion 55, each leading end of the piercing portions 56 pierces an insulating coat 100*a* of the FFC 100 having a flat conductor 100*b*, and are turned down in the direction where their leading ends thereof approach each other thereby to hold the long thin plate-shaped flat conductor 100*b* between the piercing portions and the convex portion 58. Thereafter, the piercing portions 56, 56 are welded by resistance welding or laser welding, whereby the FFC 100 and the bus bar 50 of the switch unit 33 are connected to each other electrically and mechanically (Refer to FIG. 5).

Since the constitution of the bus bars 60, 70 is nearly the same as that of the bus bar 50 except that the circuit shape is different, its detailed description is omitted. At the bus bar 60, a connecting portion 61 for electrically connecting to the reflector 31 is formed.

And, these bus bars 50, 60 and 70, as shown in FIG. 1, are arranged on the upper surface of the insulating housing 34. In this case, the round conductor connecting portion 52, 62 and 72 are respectively arranged on a more distant side (on the left side in FIG. 1) from the reflector 31 than the flat conductor connecting portions 55, 65 and 75.

Further, as shown in FIG. 1, each of bus bars 50, 60, 70 is arranged on the upper surface of the insulating housing 34 so that the respective press-fitting pieces 53, 63, 73 of the round conductor connecting portions 52, 62 and 72 face in the same direction and become parallel to one another, and so that the respective piercing portions 56, 66 and 76 of the flat conductor connecting portions 55, 65 and 75 face in the same direction and become parallel to one another.

In case that the switch unit 33 is fixed to the FFC 40, as shown in FIG. 3, the FFC 40 is press-fitted and connected to the round conductor connecting portions 52, 62 and 72 of the bus bars 50, 60 and 70 provided on the upper surface of the insulating housing 34, and simultaneously the connecting portion 61 of the bus bar 60 is tightened to the reflector 31 by a rivet or the like, so that they are electrically connected to each other.

And, the strain relief cover 36 is closed and each fitting claw 37 is locked in a fitting hole 80 of the insulating housing 34, whereby the FFC 40 is held and fixed in the switch unit 33 that is a lamp functional portion (refer to FIG. 4). On the inner wall surface of the cover 36 opposed to the round conductor connecting portions 52, 62 and 72 when the strain relief cover 36 is closed, electric wire pressing members 38 are respectively provided projectingly, whereby the FFC press-fitted and connected to each of the press-fitting pieces 53, 63 and 73 can be reliably pressed down.

Lastly, a bulb is inserted between two bulb contacts opposed to each other in the reflector 31 thereby to complete the assembly of the lamp functional portion.

In case tat the FFC 40 is fixed in the switch unit 33, a worker can fix it while he is viewing the connection state with his eye and confirming the working at a downward look, and he can perform the press-fitting work of each round conductor 40*b* in the lump. Therefore, the assembly efficiency improves and efficiency of productivity can improve.

In case that the room lamp 30 of this embodiment is previously attached to the roof trim 85 to form a roof module, the switch unit 33 connected to the connecting portion of the FFC 40 and the reflector 31 are firstly mounted to the opened lamp attaching window 86.

In this case, the trim attaching portions 32, 32 of the reflector 31 are fitted to the opening edges of the lamp-attaching window 86, whereby the lamp functional portion is directly attached to the roof trim 86. These trim attaching portions 32, 32 are flexible fitting pieces that deform elastically in the opposite direction to each other, and they are fitted without being rattled.

On the other hand, the cover lens 91 that constitutes the design portion of the room lamp 30 is attached so as to surround the switch unit 33 and reflector 31 previously attached to the lamp-attaching window 86 from the vehicle inside.

In a slide groove 93 provided for the cover lens 91, a switch knob 92 having the predetermined color and shape is previously fitted slidably. When the cover lens 911 is assembled to the roof trim 85, the leading end of the switch lever 81 is fitted into a fitting portion 92*a* of the switch knob 92. Accordingly, the switch lever 81 is operated by the switch knob 92 from the room side.

Next, the FFC 40 is laid on the body panel side of the roof trim 85 (upside in FIG. 4), and ceiling equipments such as a back mirror and a sun visor which are not shown are previously attached to the roof trim 85, whereby a roof module in which these ceiling equipments are integrated with the roof trim 85 is constituted.

Therefore, only by attaching this roof module to the body ceiling, the assembly-to working is completed and the attachment working of the ceiling equipments can be omitted at the roof trim attaching time, so that the assembly-to working is simplified.

In case that the roof harness laid in the roof trim 85 is the FFC having the flat conductors 10*b*, as shown in FIG. 5, the FFC 100 is welded to the flat conductor connecting portions 55, 65 and 75 of the bus bars 50, 60 and 70 provided on the upper surface of the insulating housing 34 thereby to connect the FFC 100 and the respective bars 50, 60 and 70 of the switch unit 33 electrically and mechanically. Further, the strain relief cover 36 is closed and the respective fitting claws 37 are locked in the fitting holes 80 of the insulating housing 34, whereby the FFC 100 is held and fixed to the switch unit 33 that is the lamp functional portion.

Namely, according to the electric wire connecting structure of the room lamp 30 in this embodiment, regardless of mode of the wire conductors fixed to the bus bars 50, 60 and 70 of the switch unit 33, the FFC 40 or FFC 100 constituting the roof harness can be reliably fixed to the respective bus bars 50, 60 and 70, and it is not necessary to prepare the plural kinds of bus bars according to the shape of the wire conductor.

Accordingly, productivity of the room lamp 30 improves and wide application is heightened, so that the manufacturing cost can be reduced.

Further, the bus bars 50, 60 and 70 provided on the upper surface of the insulating housing 34 are put side by side with the reflector 31 that is the lamp attaching portion of the lamp functional portion, and the round conductor connecting portion 52, 62 and 72 comprising the press-fitting terminal portions are arranged on the more distant side from the reflector 31 than the flat conductor connecting portions 55, 65 and 75.

Accordingly, the flat conductor connecting portions 55, 65 and 75 are coupled to the FFC 100 with the metal therebetween by welding and high in connection reliability and are arranged near the reflector 31 to which the bulb used as a heat generator is attached, while the round conductor connection portions 52, 62 and 72 having a possibility of producing stress relief of the press-fitting portions due to heat influence are arranged distantly from the reflector 31.

Accordingly, even if the round conductor connecting portions 52, 62 and 72 are constituted as a press-fitting portion that is easy in connecting operation, they become hard to receive the influence of heat, so that the connection reliability can be easily obtained. Therefore, the connecting work performance of the FFC 40 in relation to the switch unit 33 can be improved.

In the above embodiment, a case where the room lamp 30 that is the lamp unit is attached to the roof trim 85 that is the interior wall material was described. However, the invention can be applied also to a case where a map lamp is attached to the roof trim or a case where a lamp unit such as a courtesy lamp is attached to a door trim used as an interior wall material for covering a vehicle body panel such as a door panel.

Further, the electric wire laid in the interior wall material is not limited to the FFC of the above embodiment but a FPC (flexible print wiring substrate), a flat circuit body of ribbon electric wire, and a wire harness can be also used.

Further, the constitution of the round conductor connecting portion and the flat conductor connecting portion that are provided for the electric wire connecting terminal is not also limited to the press-fitting connection and welding connection in the above embodiment but it may adopt the various modes, needless to say.

For example, after leading ends of a pair of parallel piercing portions that are provided connectedly at both side edges of the bottom plate of the electric connecting terminal and stand erect pierce respectively the insulating coat 100*a* of the FFC 100 and the flat conductor 100*b*, they are turned down in the direction where they approach each other, whereby the FFC 100 and the switch unit 33 may be connected to each other electrically and mechanically. Namely, so-called piercing connection may be adopted.

According to the above electric wire connecting structure of the lamp unit of the invention, in case that a conductor of an electric wire laid on a vehicle body panel side and fitted to an electric wire connecting terminal is a round conductor, the electric wire can be fitted to a round conductor connecting portion. On the other hand, in case that a conductor of an electric wire is a flat conductor, the electric wire can be fixed to a flat conductor-connecting portion.

Namely, regardless of mode of the wire conductors to be fixed, the electric wire on the vehicle body side can be reliably fixed to the electric wire connecting terminal, and it is not necessary to prepare the plural kinds of electric wire connecting terminals according to the shape of the wire conductor.

Accordingly, productivity of the lamp unit improves and wide application heightens, so that the manufacturing cost can be reduced.

What is claimed is:

1. An electric wire connecting structure comprising:

a lamp unit attachable to a lamp-attaching window provided in an interior wall covering a vehicle body panel, the lamp unit including a design portion disposed below the interior wall and a lamp functional portion disposed above the design portion, and at least two electric wire connecting terminals provided on the lamp functional portion, wherein each of the electric wire connecting terminals includes (1) a round conductor connecting portion having press-fitting terminal portions for piercing through a round wire cable, and (2) a flat conductor connecting portion having piercing portions for piercing through a flat wire cable, the round conductor connecting portion and the flat conductor connecting portion respectively corresponding to a conductor shape of the round wire cable and the flat wire cable, at least one of the round wire cable and the flat wire cable lain on a body panel side of the interior wall and fixed to the electric wire connecting terminals, wherein the lamp functional portion includes a bulb holding portion, wherein the electric wire connecting terminals are disposed side by side on a body of the lamp functional portion, and wherein the press-fitting terminal portions, of the round conductor connecting portions are located further from the bulb holding portion than the piercing portions of the flat conductor connecting portions.

* * * * *